United States Patent [19]

Albrecht et al.

[11] 4,412,872

[45] Nov. 1, 1983

[54] PROCESS FOR MANUFACTURING A COMPONENT FROM A TITANIUM ALLOY, AS WELL AS A COMPONENT AND THE USE THEREOF

[75] Inventors: Joachim Albrecht, Deutscher; Thomas Duerig, Nussbaumen; Dag Richter, Carouge, all of Switzerland

[73] Assignee: BBC Brown, Boveri & Company Limited, Baden, Switzerland

[21] Appl. No.: 359,858

[22] Filed: Mar. 19, 1982

[30] Foreign Application Priority Data

Mar. 23, 1981 [CH] Switzerland ..... 1934/81

[51] Int. Cl.[3] ..... C22C 34/10

[52] U.S. Cl. ..... 148/11.5 F; 148/407; 148/402

[58] Field of Search ..... 428/960; 148/11.5 F, 148/407, 402

[56] References Cited

U.S. PATENT DOCUMENTS 3,652,969 3/1972 Wilson et al. ..... 428/960

4,198,081 4/1980 Harrison et al. ..... 428/960

4,205,293 5/1980 Melton et al. ..... 428/960

OTHER PUBLICATIONS

C. Baker, The Shape-Memory Effect in a Titanium 35 wt % Niobium Alloy, May 27, 1970.

*Primary Examiner*—L. Dewayne Rutledge

*Assistant Examiner*—Debbie Yee

*Attorney, Agent, or Firm*—Oblon, Fisher, Spivak, McClelland & Maier

[57] ABSTRACT

A process for manufacturing a component from a mechanically unstable β-titanium alloy which exhibits 3 shape-related memory effects which all differ from one another: a one-way effect, a two-way effect (resembling a bi-metal), this effect being virtually hysteresis-free but occurring continuously over a wide phase-transformation temperature range, and an irreversible effect, which is isothermal. Utilization of the effects in thermal triggering elements (electrical switches) as well as in fixed or detachable connecting elements for components.

21 Claims, 17 Drawing Figures

Figure 1:
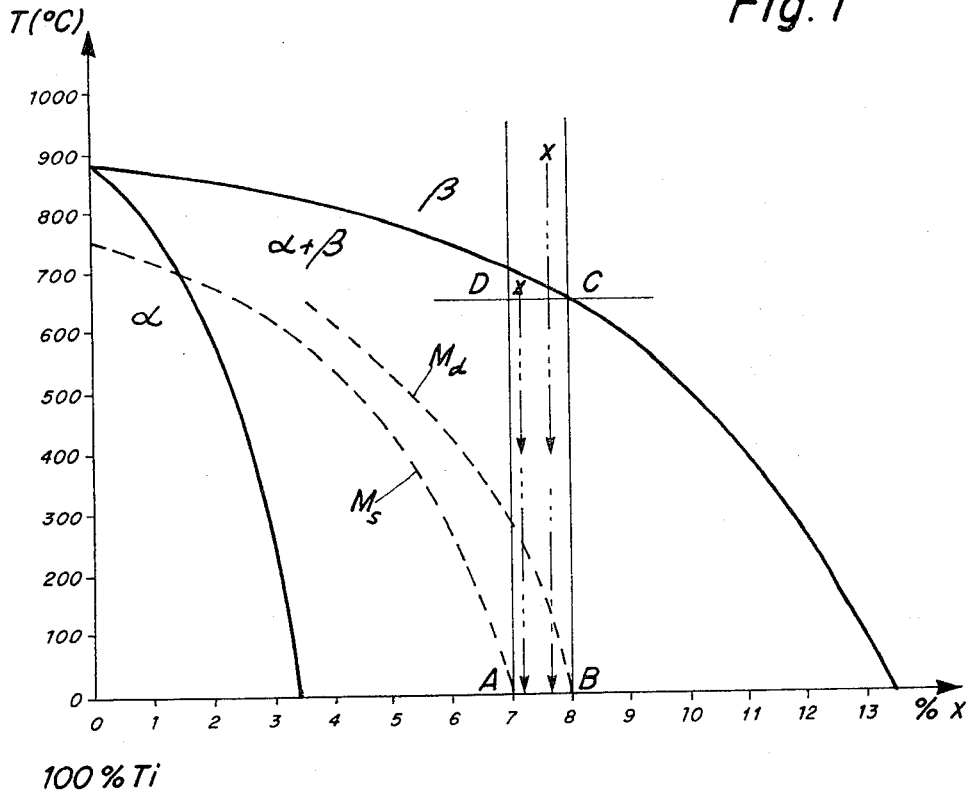

PROCESS FOR MANUFACTURING A COMPONENT FROM A TITANIUM ALLOY, AS WELL AS A COMPONENT AND THE USE THEREOF

The invention starts from a process for manufacturing a component from a titanium alloy, according to the precharacterizing clause of claim 1, as well as a component, according to the precharacterizing clause of claim 11, and the use of a component according to the precharacterizing clause of claim 18.

It has been known for a relatively long time that certain alloys exhibit a so-called memory effect, that is to say, they possess a certain ability to recall a shape. Among these alloys, two main groups have predominated in acquiring industrial importance. The first group includes the alloys based on Ni/Ti (e.g. Buehler, W. J., Cross, W. B.: 55 Nitinol, unique wire alloy with a memory. Wire J. 2 (1969), pages 41–49), or Ni/Ti/Cu, while the second group includes the copper-rich or nickel-rich alloys of the $\beta$-brass type, based on Cu/Zn-/Al, Cu/Al and Cu/Al/Ni with Ni/Al (e.g. U.S. Pat. Nos. 3,783,037 and 4,019,925). In addition, a shape memory effect has been discovered and described in a super-conducting titanium alloy containing 35% of niobium (see Baker, C.: The shape memory effect in a titanium 35 wt-% niobium alloy. Metal Sci. J. 5 (1971), pages 92–100).

All these alloys share the feature that they do not belong to a group of the classical materials which are generally available, and that they must, as a rule, be purpose-manufactured by more or less expensive processes. The latter factor applies particularly in the case of alloys which must be manufactured by powder-metallurgical processes. Furthermore, the memory alloys which have hitherto been used industrially share the feature that they are, almost without exception, comparatively brittle. The lack of ductility imposes relatively narrow limits on both their processability and their use, or necessitates appropriate additional process steps which render the finished product more expensive. In the case of the two-way effect, the conventional alloys exhibit more or less large amounts of hysteresis on being cycled through a temperature/distance loop. This hysteresis is not desired for all applications, above all if it attains appreciable values.

Memory alloys based on Ni/Ti possess an $M_S$ temperature, at which the martensitic transformation occurs, which cannot, for theoretical reasons, exceed 80° C. and, in practical cases, usually does not exceed 50° C., and which is too low for many applications, above all in the field of thermal-type electrical switches. Moreover, alloys of this type are expensive, especially if additional allowance is also made for the manufacture of the components, which further increases the cost.

The copper alloys belonging to the $\beta$-brass type, such as e.g. Cu/Al/Ni, have a tensile strength which does not exceed 600 MPa and which is too low for many practical applications. In addition, their $M_S$ temperature depends strongly on the accuracy of the composition, particularly on the aluminum content, and this makes these alloys difficult to reproduce, since it is precisely the aluminum which, due to its high vapor pressure, leads to losses during the melting of the alloys, and, in consequence, deviations from the required analysis, and these losses are difficult to control.

There is accordingly a need to extend the field over which the memory effects can be applied, by the novel selection of alloys which have not previously been considered, and of suitable material-specific processes, and by manufacturing components by appropriate methods.

The object underlying the invention is to indicate a process for manufacturing a component from a titanium alloy, as well as a component and the use thereof, which process makes use of the exploitation of the martensitic transformation for the purpose of obtaining a memory effect. There is the additional object, to characterize the memory effect, in more detail, in its various manifestations, and to demonstrate its utilization in technology. This object is achieved, according to the invention, by the features of claims 1, 11 and 18.

Figure 2:
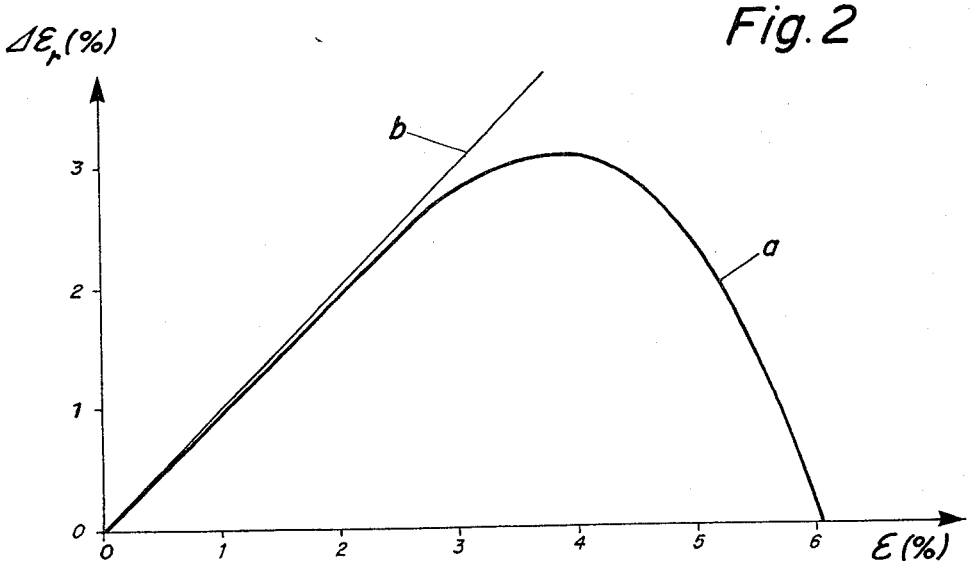
Figure 3:
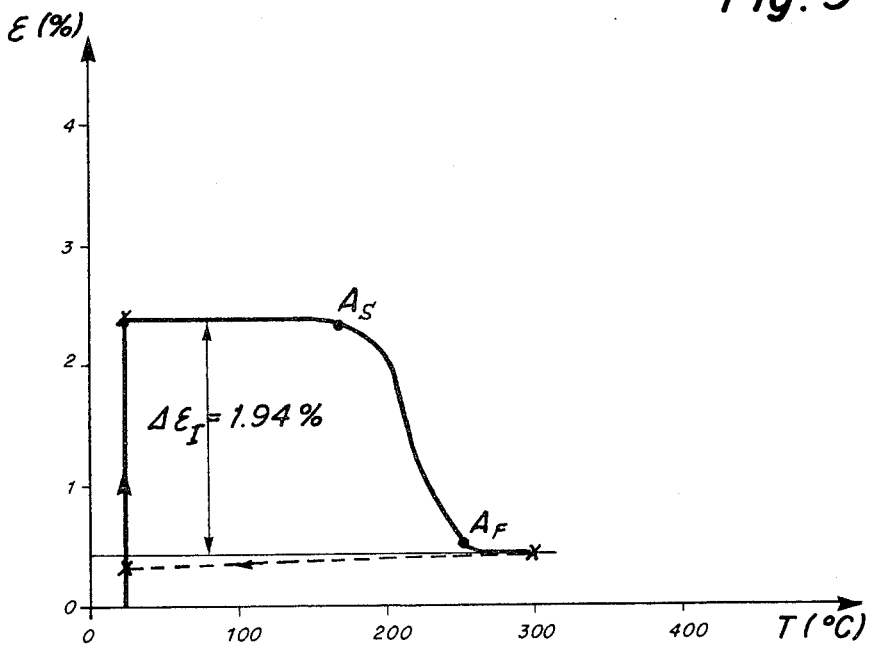
Figure 4:
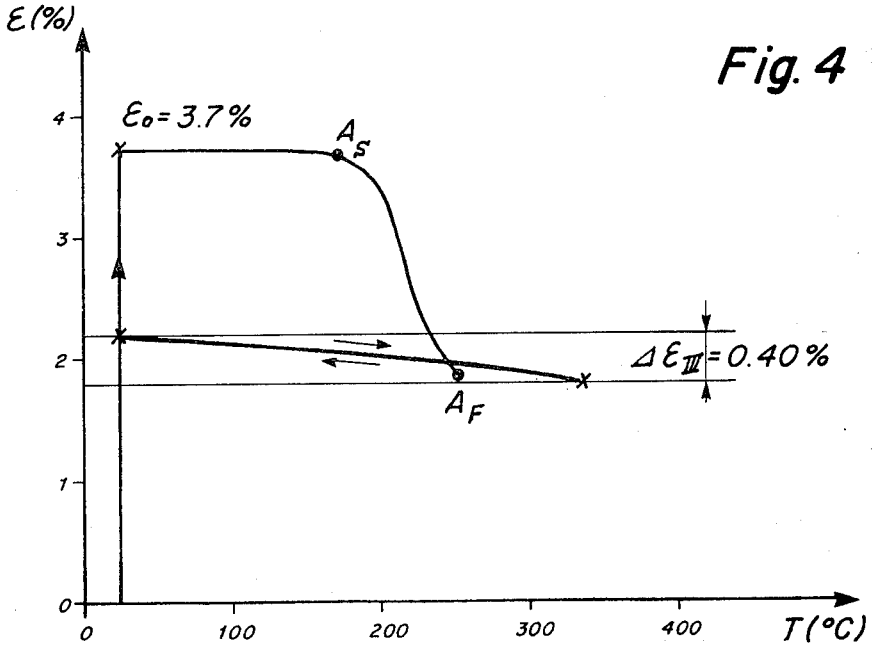
Figure 5:
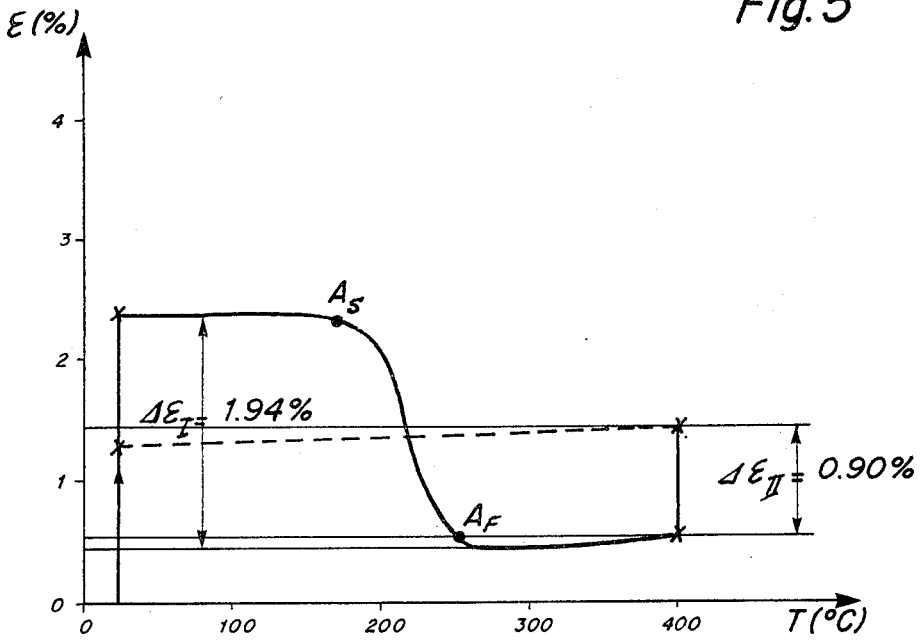
Figure 6:
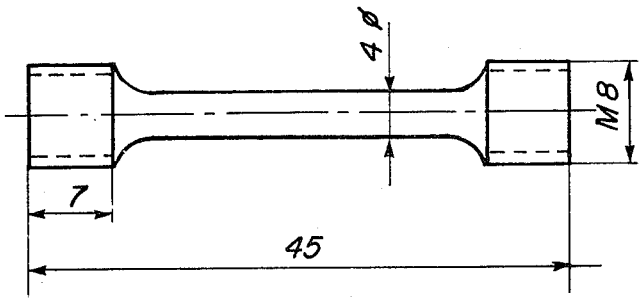
Figure 7:
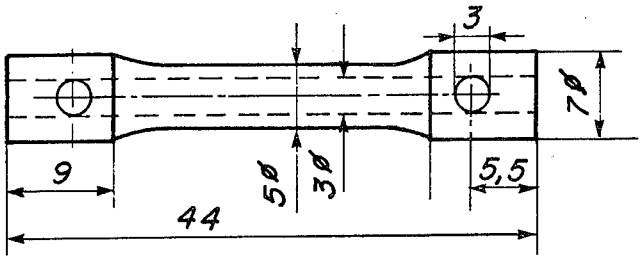
Figure 8:
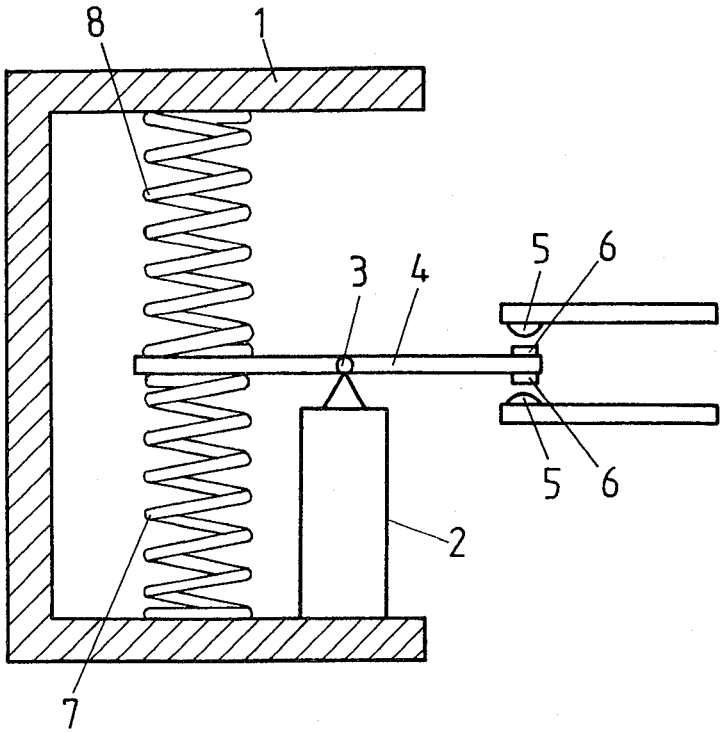
Figure 9:
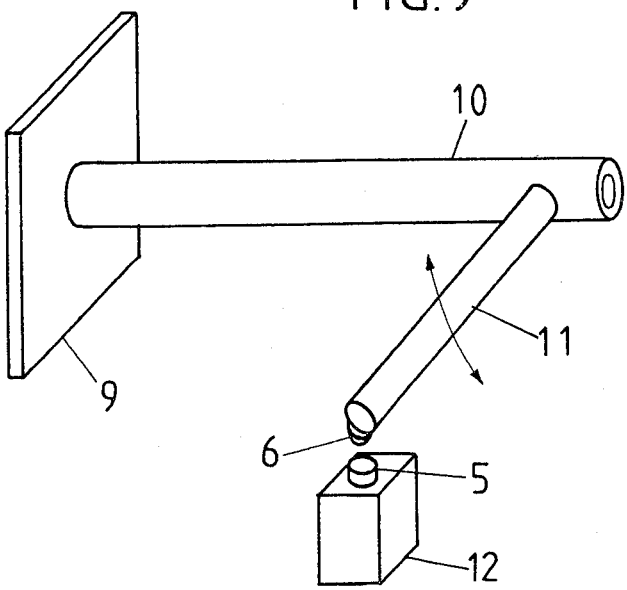
Figure 10:
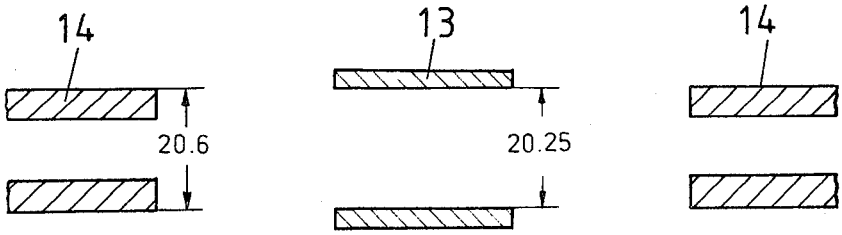
Figure 11:
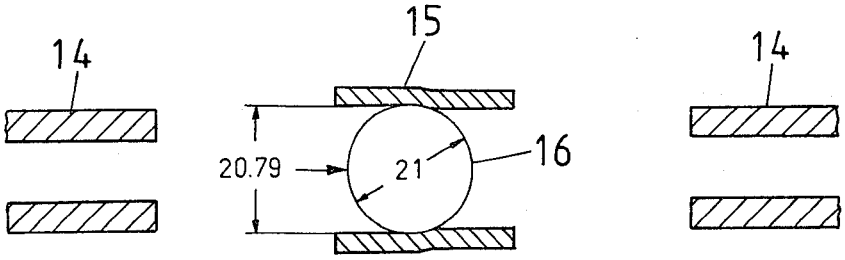
Figure 12:
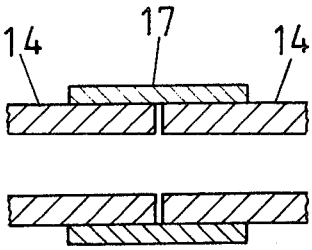
Figure 13:
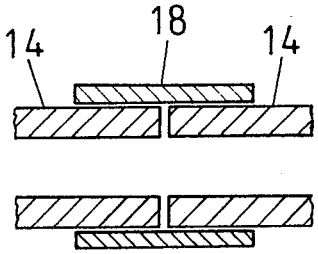
Figure 14:
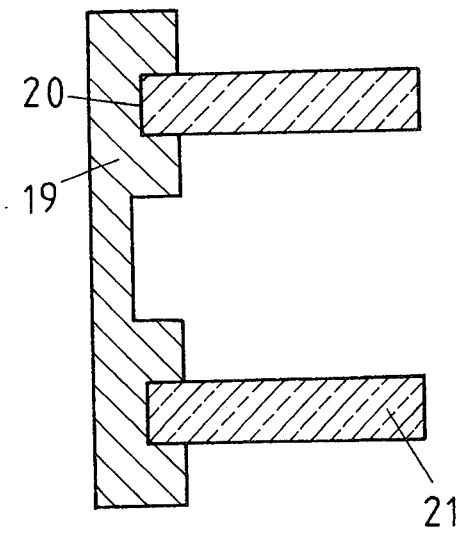
Figure 15:
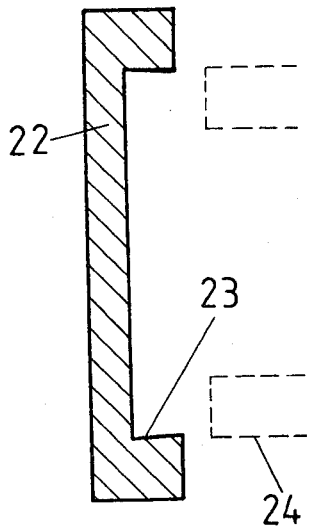
Figure 16:
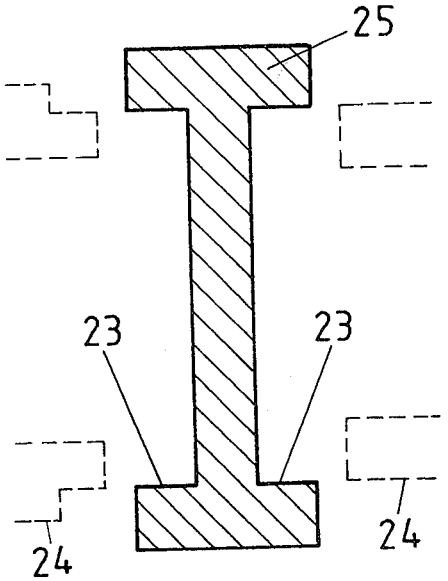
Figure 17:
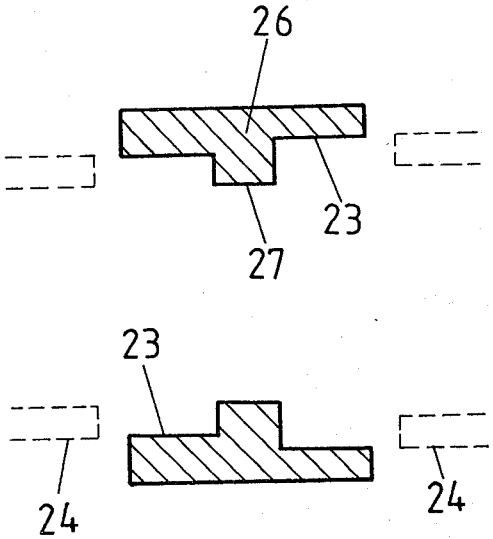

The invention is described by reference to the illustrative embodiments which follow and which are explained by the Figures, in which:

FIG. 1 shows a section from a schematic phase diagram of a binary titanium alloy, FIG. 2 shows, for a titanium alloy, the variation of the recoverable strain, as a function of the permanent strain which has been applied, FIG. 3 shows, for the one-way effect, the progress of the shape-change, plotted against the temperature, FIG. 4 shows, for the two-way effect, the progress of the shape-change, plotted against the temperature, FIG. 5 shows, for the isothermal effect, the progress of the shape-change, plotted against the temperature, FIG. 6 shows the dimensions of a test-bar for tensile tests, FIG. 7 shows the dimensions of a test-bar for torsion tests, FIG. 8 shows a diagrammatic sectional representation of an electrical switch with helical springs, FIG. 9 shows a diagrammatic perspective representation of an electrical switch with a torsion bar, FIG. 10 shows the longitudinal section through a shrink-down connection, in the starting position, FIG. 11 shows the longitudinal section through a shrink-down connection, at the moment of the expansion, FIG. 12 shows the longitudinal section through a shrink-down connection, after assembly, FIG. 13 shows the longitudinal section through a shrink-down connection, after being released, FIG. 14 shows the longitudinal section through a ceramic seal, FIG. 15 shows the longitudinal section through a closure for a hollow body, before assembly, FIG. 16 shows the longitudinal section through a connection, possessing an internal partition, for hollow bodies, before assembly, FIG. 17 shows the longitudinal section through a connection with different diameters, for hollow bodies.

FIG. 1 represents a section from a schematic hypothetical phase diagram of a binary titanium alloy, this section being concerned with the titanium side. The ordinate represents the temperature scale and corresponds, at the same time, to 100% Ti, that is to say 0% of the alloying element. The alloying element X is plotted on the abscissa, in percent (for example % by weight). The curves indicated by continuous lines subdivide the diagram into the $\alpha$-phase region, the $(\alpha+\beta)$-phase region and the $\beta$-phase region. Two additional curves $M_S$ and $M_d$, drawn with broken lines, are related to the phase-transformation (martensite formation), which occurs on quenching from the $\beta$-region, and will be explained in more detail later in the text. They meet the 0° C.-isotherm (abscissa) at the points A and B respectively. If a vertical line is drawn at B, it meets the $\beta$-transformation line at C. The isotherm drawn through C interesects the vertical line drawn from A at the point D. The line $\overline{CD}$ forms the upper limit of the region from which the titanium alloy must be quenched in order to obtain the desired microstructural condition required for the memory effects (so-called "mechanically unstable $\beta$-titanium alloy").

FIG. 2 shows a diagram in which the variation of the recoverable strain $\Delta\epsilon_r$ (%) is represented, for a titanium alloy, as a function of the permanent strain $\epsilon$ (%) which was originally applied, as curve a. For comparison, the line b for ideal recovery (100%) is drawn in as a straight line inclined at 45°. It is found that, up to permanet strains of over 2%, the two lines virtually coincide, that the maximum recoverable strain amounts to approximately 3%, and that a primary permanent deformation in excess of 6% no longer produces a memory effect. The diagram has, of course, a fundamental character, and the numerical values are different for different alloys. In the present case, the diagram is numerically valid for a titanium alloy with approximately 10% by weight of vanadium, 2% by weight of iron, and 3% by weight of aluminum (Ti-10V-2Fe-3Al).

FIG. 3 represents a diagram of the progress of the shape-change, plotted against the temperature, for the one-way effect in a $\beta$-titanium alloy (in this case, Ti-10V-2Fe-3Al). $A_S$ is the temperature at which the martensite (low-temperature phase) starts to be retransformed into the high-temperature phase. $A_F$ represents the temperature corresponding to the end of this phase-transformation. In the present case, where the deformation was accomplished by tension, a permanent strain of 2.39% being applied, the recoverable proportion $\Delta\epsilon_I$ amounts to 1.94%. The arrows indicate the correct direction around the deformation/temperature loop. The broken line denotes the purely thermal contraction of the workpiece after cooling to room temperature. The diagram has a fundamental character and is qualitatively valid for all mechanically unstable $\beta$-titanium alloys.

FIG. 4 reproduces the progress of the shape-change, plotted against the temperature, for a titanium alloy which exhibits the two-way effect. The original permanent deformation $\epsilon_o$, produced by tension, amounted to 3.7% in this case, and was thus greater than for inducing the one-way effect. The reversible strain $\Delta\epsilon_{III}$ amounting to 0.4% and varying uniformly with the temperature, shows virtually no hysteresis. The mechanism is different from that of the known Ni/Ti alloys. The material basically behaves in a manner similar to a bimetallic strip. Over the temperature interval under discussion, between room temperature and approximately 300° C., the form of the curve is slightly convex in the upward direction (concave towards the temperature axis). The statement made with reference to FIG. 3, regarding its fundamental nature, also applies here.

FIG. 5 shows the progress of the shape-change, plotted against the temperature, for the irreversible isothermal effect in the alloy Ti-10V-2Fe-3Al. Following a primary deformation produced by tension (permanent strain $\epsilon$=2.39%), the material was initially cycled through the one-way effect, from $A_S$ to $A_F$, which resulted in the usual contraction $\Delta\epsilon_I$, of 1.94%. After heating the material to a still higher temperature (to approximately 400° C., in the present case), the isothermal memory effect took place, this effect progressing in the opposite direction and implying, in this case, an elongation $\Delta\epsilon_{II}$ of 0.9%. In this case as well, the statement with regard to FIG. 3 is valid.

FIGS. 6 and 7 show, respectively, test-bars for tensile tests and torsion tests, with the length and diameter measurements, and require no further explanations. In accordance therewith, the torsion tests were carried out on test-bars in the form of hollow cylinders.

FIG. 8 diagrammatically represents an electrical switch, in section, this switch using helical springs as components. 1 is a housing, inside which a support 2 is attached, which carries the bearing 3 for the contact lever 4. 5 and 6 respectively represent a fixed contact and a moving contact. The contact lever 4 is held in a preselectable rest position by means of the springs 7 and 8. This can be the position shown in the drawing (both contact-points open), or can also be another position (one contact-point closed). 7 is a helical spring, made from a memory alloy, and can be designed as a compression spring or as a tension spring, with or without preload. 8 is a conventional helical spring which can again act as a tension spring or as a compression spring, with or without preload. Depending on the design chosen for 7 and 8, and depending on the combination of these springs which is being used, 8 acts against the memory effect of 7 (pull-back spring or counter-spring), or reinforces this effect (auxiliary spring).

FIG. 9 shows a diagrammatic perspective representation of an electrical switch using a torsion bar. 9 is a base plate, on which a torsion bar 10 is attached at right angles, this torsion bar being made of memory alloy. The torsion bar in turn carries, at its end, the switching arm 11, the mobility (pivoting range) of which is indicated by a double arrow. At its end, the switching arm 11 possesses a moving contact 6 which opposes a fixed contact 5, the latter being secured in the holder 12.

FIGS. 10 to 13 show the process sequence in the manufacture of both a fixed and a detachable connection. 14 represents, in each case, a tube, which is to be connected, in longitudinal section. 13 is a sleeve, made of a memory alloy, the internal diameter of which, in the starting condition before expansion, being sized to be smaller than the external diameter of the tube. 15 shows the sleeve during the expansion process which uses a ball 16. 17 represents the sleeve following the process of shrinking over the tubes 14 (one-way memory effect). This corresponds to the state of a fixed tube-connection. The state following the release (if required) of the same connection is represented in FIG. 13. 18 is the sleeve following the expansion process, loosened again as a result of the isothermal memory effect.

FIGS. 14 to 17 show illustrative embodiments of seals, hollow-body closures and hollow-body connections. 19 represents a disk, made of a memory alloy and provided with a groove 20. 21 is a hollow body, made of ceramic material, which engages into the groove 20 in a vacuum-tight manner. The disk 22, which is provided with a conical relieved portion 23, is composed of a memory alloy. The hollow body 24 to be connected, made of metal, plastic, or ceramic material is indicated, prior to assembly, by broken lines. 25 represents a disk, made of a memory alloy, on which a shoulder has been machined on each side, this disk exhibiting in each case, a cylindrical relieved portion 23. As indicated, the ends of the hollow bodies 24 can have different shapes. In the present case, the disk 25 serves both as a connecting element and as an internal partition. 26 is a hollow body, made of memory alloy, on which shoulders have been machined and which exhibits the relieved portions 23 as well as a central opening 27. The hollow bodies 24, which are to be connected, can be of different diameters and, of course, be of different materials.

Among the titanium alloys, there are those which exhibit memory effects following a suitable thermal and thermomechanical pretreatment. The composition range of these alloys is subject to comparatively narrow limits. First of all, it is essential that, in the stable starting condition at room temperature, they contain at least some of the cubic body-centered $\beta$-phase. Pure $\alpha$-alloys are consequently excluded. The same applies in the case of alloys which are pure $\beta$-phase at room temperature, since it is certain that no further phase-transformation takes place in that region ($\beta$-phase stable down to room temperature). In practical terms, the alloys must accordingly fall into the heterogeneous $(\alpha+\beta)$-phase region when in the starting condition at room temperature. A further restriction in the composition now derives from the fact that the alloys must belong to the class of the mechanically unstable $\beta$-titanium alloys (in the context of this invention), these alloys being basically defined as follows:

Alloy, characterized by the property that at least some of its cubic body-centered $\beta$-phase can, by applying a permanent deformation, be transformed into the stress-induced martensitic $\alpha''$-phase.

Under practical conditions, this transformation can be confirmed by subjecting a thin sheet of the $\beta$-titanium alloy, not more than 1 mm thick, first to a solution-annealing treatment above the $\beta$-transformation temperature, followed by quenching in ice-water, this being done within a cooling time, not exceeding 10 seconds, for passing through the difference between the solution-annealing temperature and 100° C. After quenching, the material should exhibit no more than 10% by volume of thermally-induced martensite.

The alloy is further characterized by the feature that the $\beta$-phase transforms into martensite ($\alpha''$) during subsequent mechanical working. The maximum temperature at which mechanically-induced martensite ($\alpha''$) can be found after this working operation is defined as $M_d$.

The trend of the $M_S$ and $M_d$ lines is drawn, plotted against the temperature, in the schematic hypothetical phase diagram in FIG. 1. In this diagram, $M_S$ represents the temperature at which the formation of martensite starts. $M_d$ has already been defined in detail above. The condition accordingly results, for the alloys which can be considered for practical use at room temperature, that their composition must fall approximately within the region between A and B, the points at which the $M_S$ and $M_d$ lines intersect the 0° C. isotherm. In order to obtain the desired memory effects in full, it is desirable to produce as much stress-induced martensite as possible during the subsequent primary permanent deformation. This is achieved by a process wherein the component is previously quenched from a region above the $\beta$-transformation line, as indicated by the dash-dotted vertical line, with the arrow, running on the right-hand side. At the least, however, quenching should be carried out from a temperature corresponding to the isotherm $\overline{CD}$, since the above condition can no longer be fulfilled on quenching from lower temperatures, as indicated by the dash-dotted vertical line, with arrow, on the left-hand side. In the latter case, a proportion of material is lost, which, on crossing the $\beta$-transformation line, transforms into the stable $\alpha$-phase and is lost to the memory effect, although this proportion, indicated by the lever law, is small. For the remaining proportion of $\beta$-phase, however, the conditions for the subsequent formation of martensite remain optimal.

In accordance with the definition, according to the invention, of the mechanically unstable $\beta$-titanium alloy, all alloying elements which have a stabilizing action on the cubic body-centered $\beta$-phase are suitable in principle. These elements are V, Al, Fe, Ni, Co, Mn, Cr, Mo, Zr, Nb, Sn and Cu, and they can be used both individually and in combination. Certain concentration limits can be specified for these elements, these limits satisfying the above conditions which can be deduced from the thermodynamic equilibria. It is accordingly possible to express the alloy composition mathematically by means of a quadratic approximation and with the aid of empirically determined relationships. The condition must be fulfilled, that the concentration limits of the alloying elements of the titanium alloy, expressed in atomic percentages, satisfy the formula $$-1100 \leqq \sum_{i}^{n} (A_i X_i + B_i X_i^2) \leqq -700,$$

in which $X_i$ stands for the concentration of the element in question in atomic percent, and the coefficients $A_i$ and $B_i$ are assigned to the element in question in accordance with the Table below:

| Element | $A_i$ | $B_i$ |
|---|---|---|
| V | −29.1 | −1.8 |
| Al | −15.6 | −1.1 |
| Fe | −132.8 | −17.2 |
| Ni | −67.5 | −1.5 |
| Co | −72.0 | −6.0 |
| Mn | −84.9 | −7.6 |
| Cr | −72.0 | −6.0 |
| Mo | −66.7 | −3.3 |
| Zr | −16.9 | +0.3 |
| Nb | −19.3 | −0.53 |
| Sn | −25.2 | +1.8 |
| Cu | −38.3 | −1.3 |

Titanium alloys which belong to the binary type and which, in addition to titanium, further contain 14 to 20% by weight of vanadium, or 4 or 6% by weight of iron, or 6.5 to 9% by weight of manganese, or 13 to 19% by weight of molybdenum, are particularly suitable.

Further preferred alloys are those which belong to the ternary type and which, in addition to titanium further contain 13 to 19% by weight of vanadium plus 0.2 to 6% by weight of aluminum, or 4 to 6% by weight of iron plus 0.2 to 6% by weight of aluminum, or 1.5 to 2.3% by weight of iron plus 10 to 14% by weight of vanadium.

In addition, there is a group of alloys which belong to the quarternary type and which, in addition to titanium, further contain 9 to 11% by weight of vanadium, plus 1.6 to 2.2% by weight of iron, plus 2 to 4% by weight of aluminum.

The mechanically unstable $\beta$-titanium alloys (in the context of this invention) defined and characterized in detail above, exhibit 3 shape-memory effects, each of which depends on the thermomechanical or mechanical pretreatment, and on the temperature region. If a stress is exerted on an alloy of this type by tension, compression, or shearing, or a combination of two or more of these operations, in a manner such that a primary permanent deformation is produced, the preconditions for setting up a memory effect are thus established. As a result of heating the component, immediately after the deformation operation, to a temperature above $A_S$ the one-way effect first occurs (see FIG. 3). On further heating, up to $A_F$, the effect is terminated, this effect taking the form of a deformation in the direction opposite to the original deformation direction. $A_S$ and $A_F$ thus indicate, respectively, the temperatures at which the retransformation of the martensite, into the high-temperature phase, starts and is terminated. In contrast to conventional memory alloys, $A_S$ and $A_F$ are comparatively high in the case of mechanically high unstable $\beta$-titanium alloys (in the region above 100° C.), and this opens up a new field of applications. If the component is cooled to room temperature from a temperature in the vicinity of $A_F$, the deformation obtained by means of the one-way effect is thus preserved. In this way, it is possible, for example, to realize strong connections between components. If the primary permanent deformation is increased beyond a certain amount, the one-way effect initially recurs on subsequent heating, tranversing the section between $A_S$ and $A_F$. If now the material is heated a little more, beyond $A_F$, it is now in the condition in which it exhibits a two-way effect (see FIG. 4). During cooling from a temperature range of approximately 300° to 350° C. down to room temperature, the component suffers a deformation which takes place in the opposite direction to that of the one-way effect and as a result of which the permanent deformation, which had been applied originally, is rectified. In contrast to the conventional memory alloys of the Ni/Ti and $\beta$-brass type, this deformation takes place smoothly with respect to the temperature, and virtually without hysteresis—the behaviour of the material has thus something in common with that of a bimetal. In the present case, with Ti-10V-2Fe-3Al, the curve is not linear, but is slighty curved, so that it appears concave in the direction of the temperature axis. If a material which has been pretreated, in the usual manner, for the one-way effect is heated appreciably beyond $A_F$, and is held at the temperature thus attained, a third effect can be observed, namely the isothermal memory effect (see FIG. 5). In this event, the component deforms in a direction in opposition to the one-way effect. In the case of the abovementioned titanium alloy, this effect is triggered at approximately 400° C. It is irreversible and is attributable to the transformation of the martensitic $\alpha''$-phase into the stable $\alpha$-phase, the microstructure then consisting essentially of the stable phases $\alpha$ and $\beta$. This effect can be utilized, for example, in the design of a detachable shrinkdown connection.

During the manufacture of the component from the titanium alloy, it is necessary to cool the workpiece from the temperature region specified above—preferably above the $\beta$-transformation line—at a rate which is sufficiently high, on the one hand, to retain the mechanically unstable $\beta$-phase and, on the other hand, to suppress the formation of any new phase, except for the athermal $\omega$-phase. In addition, there is the further requirement that the formation, by quenching, of thermally-induced martensite should not be allowed to exceed a maximum of 10% by volume. This requirement is thus concerned with the need to carry over the $\beta$-microstructural condition, down to room temperature, by quenching, in as pure a state as possible. The ideal case is represented by 100% of the mechanically unstable $\beta$-phase. The martensite should most certainly not form until later, as the result of applying a deformation, that is to say, its formation should be stress-induced. As far as the athermal $\omega$-phase is concerned, its formation cannot always be entirely avoided. In any case, any possible $\omega$-precipitates are undesirable with regard to the stability of the memory effect. The upper limit of the expedient amount of permanent deformation required for inducing the martensite results from the fact that the plateau of the recoverable strain is used up when the deformations become relatively large (see FIG. 2, where this limit lies at approximately 6% for Ti-10V-2Fe-3Al). It is intended, in the text which follows, to define the temperature $A_S$, which has already been generally described above, more accurately, as a process-technology parameter in the context of this invention. $A_S$ should be understood as that temperature at which 1/100 of the primary permanent mechanical deformation, previously applied, has been reformed. As a further parameter, characteristic of the memory effects, $A_{90}$ should be introduced, which should be understood as that temperature at which the microstructure of the component, after previous deformation and subsequent heating, still contains a maximum of 10% by volume of martensite.

If the one-way effect is to be obtained, the workpiece must first undergo primary deformation, and then be heated to a temperature above $A_S$. In the case of the isothermal effect, the workpiece must be heated to a temperature at which the stable $\alpha$-phase precipitates and it must be held at this temperature until at least 1% by volume of the original phase has transformed into the $\alpha$-phase. If the two-way effect is to be utilized, the workpiece must first be subjected to the primary deformation and then heated to a temperature above $A_{90}$, followed by cooling to a temperature below $A_S$. The above-mentioned conditions are the minimum conditions for obtaining the specified memory effects to any extent at all. However, the optimum one-way effect is obtained only after heating to a temperature in the region of $A_F$. For the isothermal effect, it is generally necessary to heat to a temperature at least 50° C. above the $A_F$-point. The two-way effect can be obtained by heating to a temperature between $A_S$ and $A_F$, the microstructure being composed partly of the $\alpha''$-phase, and partly of the $\beta$-phase.

ILLUSTRATIVE EMBODIMENT I $\beta$-titanium alloys are generally manufactured by double electric-arc melting, using a consumable electrode. The starting materials are titanium sponge and appropriate master alloys. The melting process is carried out in vacuum, or under a protective gas with a low partial pressure of hydrogen. To manufacture a component, the alloy components are mixed, melted and cast, and the workpiece thus obtained is hot-worked and subjected to a solution-annealing treatment in the temperature region within which at least some of the stable $\beta$-phase exists. The workpiece is thereupon quenched to room temperature, and subjected to a mechanical working operation and a further heat-treatment.

In the present case, the starting material was a semi-finished product, in the form of a cylindrical forging having a diameter of 254 mm and a weight of 130 kg. The titanium alloy corresponded to the designation Ti-10V-2-Fe-3Al and its actual composition was as follows:

V=9.3% by weight
Fe=1.8% by weight
Al=3.2% by weight
C=0.03% by weight
O=0.08% by weight
remainder Ti Specimens were manufactured from the material, in its as-delivered condition, in particular tensile test-pieces according to FIG. 6, and hollow torsion test-pieces according to FIG. 7.

In order to establish a clear and reproducible starting condition, the test-pieces were solution-annealed for 60 minutes, in the $\beta$-phase region, at 850° C., and were then quenched to room temperature in moving water. In order to prevent oxidation during solution-annealing, the heat-treatment was either carried out in a vacuum furnace, or the test-pieces were placed in a silica glass ampoule, which was filled with a protective gas and hermetically sealed. The glass ampoule disintegrates immediately on being immersed in the quenching medium (water) and thus permits rapid quenching. Both during the heat-treatment in vacuo and on using the ampoule filled with protective gas, the test-pieces were, in addition, loosely wrapped in zirconium foil, in order to bind any residual oxygen by means of its high affinity for zirconium.

In order to obtain the one-way effect, tensile test-pieces were deformed at room temperature, at a strain rate $\dot{\epsilon}$ of 0.0007 $sec^{-1}$. Test-pieces, which had been permanently deformed by up to 3%, returned virtually completely to their original length (before the deformation) on being heated, in a salt-bath, to 300° C., and being held at this temperature for 60 seconds. Although test-pieces which had been deformed by more than 3% likewise exhibited a one-way effect, they no longer returned completely to their initial shape. There was no longer any measurable memory effect in the case of deformations exceeding 7% (see FIG. 2). The same phenomena could be found, with the same results, when the primary deformation was carried out by applying pressure instead of tension.

The one-way effect, measured on a tension test bar, is diagrammatically illustrated in FIG. 3. Similar results are obtained with torsion bars, or if the deformation is reversed (compressive stress).

ILLUSTRATIVE EMBODIMENT II

Tensile test-pieces and torsion test-pieces were manufactured from the same material and by the same method as indicated under Example I. A tensile test-piece was stressed, at room temperature, in a manner such that a permanent deformation of 3.7% was produced. On being heated, the test-piece initially exhibited a one-way effect, that is to say, contraction occurred in the longitudinal axis (qualitatively similar to FIG. 3). After cooling to room temperature, a longitudinal expansion was evident. The test-piece was then cyclically heated and cooled a number of times. The corresponding expansion and contraction, occurring between room temperature and approximately 340° C., amounted to 0.4% (two-way effect).

ILLUSTRATIVE EMBODIMENT III

A torsion bar (see FIG. 7) was manufactured from Ti-10V-2Fe-3Al, according to Example I. The bar was twisted, at room temperature, through 1.16 radians (corresponding to $\epsilon$=5.8%). After removal of the load, it sprang back to a twist value of 0.774 of a radian (corresponding to $\epsilon$=3.87%) of permanent deformation. On heating to 320° C., the deformation decreased to 0.61 of a radian (corresponding to $\epsilon$=3.05%). On subsequent cooling to room temperature, the deformation increased by 0.098 of a radian (corresponding to $\epsilon$=0.49%). Heating, once again, to 300° C., reduced the deformation again, by 0.082 of a radian (corresponding to $\epsilon$=0.41%). After 5 heating/cooling cycles between room temperature and 320° C., the resulting deformation difference amounted to approximately 0.078 of a radian (corresponding to $\epsilon$=0.39%). This two-way effect, in torsion, likewise corresponds qualitatively (not precisely in numerical terms) to the phenomenon illustrated in FIG. 4.

ILLUSTRATIVE EMBODIMENT IV

Tensile test-pieces were machined from Ti-10V-2Fe-3Al according to Example I and were deformed, as described therein, and heated to 300° C. On heating, the one-way effect took place, as expected, in the form of a corresponding contraction in the longitudinal direction of the bar. The test-pieces were then heated to a temperature of 400° to 450° C., and held at this temperature for 100 minutes. During this time, the test-bars expanded, in the longitudinal direction, by amounts which were of the order of magnitude of 1 to 2%, depending on the primary deformation which had been applied. This irreversible isothermal effect, taking place in the opposite direction to the one-way effect, is qualitatively illustrated in FIG. 5. It is possible, in the course of this effect, to achieve relative strain values of up to 50% (referred to the primary permanent deformation applied).

ILLUSTRATIVE EMBODIMENT V

See FIG. 8.

A wire was manufactured from the material according to Example I, which had been pretreated as specified therein, and a helical spring 7 was wound from this wire. This spring was then subjected to a treatment according to Example II or III, in order to bring about the two-way effect, in a manner such that the spring 7, which is under a slight compressive preload when in the rest condition at room temperature, contracts gradually as the temperature is increased. The spring 7, made of the memory alloy, was installed in an electrical switch according to FIG. 8, together with a conventional compression spring 8. The current is routed via the spring 8. In the normal condition, the current does not cause any heating, so that the former spring is virtually at room temperature, and is in equilibrium with the counter-spring 8. In the event of excessively high current, the heating causes the spring 7 to shorten, thereby relieving the load on the counter-spring 8, so that the upper contacts 5/6 close and, for example, thereby trigger a main switch for the purpose of interrupting the current circuit. All the reverse combinations of 7 and 8 can, of course, be implemented, as described under FIG. 8.

ILLUSTRATIVE EMBODIMENT VI

See FIG. 9.

From the material according to Example I, and following the pretreatment specified therein, a torsion bar was manufactured according to FIG. 7. The bar was subjected to further treatment, according to Example II or III, in order to produce the two-way effect. The prepared torsion bar 10 was then provided with a switching arm 11 and mounted on the base plate 9. All further constructional elements of the electrical switch can be seen from the description relating to FIG. 9. In this switch, current can flow directly through the torsion bar 10 (direct heating), or the bar can be closely surrounded by an insulated heating coil (indirect heating). The triggering mechanism is fundamentally the same as that specified in Example I, but the counterspring is omitted. This design is distinguished by great simplicity. The triggering temperature can be set within wide limits by suitably selecting the geometry of the switch (length of the switching arm, pivoting range, etc.).

ILLUSTRATIVE EMBODIMENT VII

See FIGS. 10 to 13.

A sleeve 13, with internal and external diameters of 20.25 and 26.25 mm, and an axial length of 30 mm, was manufactured from Ti-10V-2Fe-3Al. This sleeve served to connect two tubes 14 (metal, plastic, ceramic material) having an external diameter of 20.6 mm. The sleeve 13 was pretreated in accordance with Example I (solution-annealing treatment, quenching treatment). Following pretreatment, the sleeve was expanded to an internal diameter of 20.79 mm, by pushing a polished steel ball 16 axially through it (see arrow in FIG. 11), this ball having a diameter of 21 mm. The tubes 14 were then pushed symmetrically into the sleeve, in the axial direction, and the whole assembly was heated to a temperature in the region of $A_F$(in the present case, approximately 260° C.). As a result of the appearance of the one-way effect, a strong, leak-proof shrinkdown connection was obtained between the tubes 14, this connection also being preserved on cooling to room temperature, since the sleeve further contracts by no more than a slight amount. The advantage of this connection, using a constructional element made of a mechanically unstable $\beta$-titanium alloy, resides in the fact that this element can be predeformed at room temperature, since the $A_S$ and $A_F$ temperatures are comparatively high. This is not the case, for example, in alloys based on Ni/Ti. In such alloys, the preliminary deformation must be carried out at temperatures far below room temperature, special coolants and suitable apparatuses being required for this purpose. In contrast to this, the heating of the titanium alloy sleeve 13 can be effected, in a simple manner, in any workshop, and even outdoors, or at the place of installation, using a blowlamp, welding torch, etc., simple means (tempering colors, temperature-indicating chalks, etc.) being adequate for monitoring the temperature.

If the connection has to be released again, this can be achieved by using the isothermal effect. In doing so, the shrunk-on sleeve 17 (FIG. 12) is brought to a temperature approximating to $A_F$ plus 100° to 150° C., whereupon the irreversible isothermal memory effect occurs and the sleeve expands (18 in FIG. 13). In this condition, the tubes 14 can be pulled out of the sleeve 18. If the intention is to re-use the sleeve, the process must be repeated from the beginning: solution-annealing treatment, quenching treatment, preliminary deformation, etc.

The application of the process, according to the invention, and the use of the components, manufactured in accordance with this process, is not restricted to the illustrative embodiments which have been described. Utilizing, according to choice, one or more of the effects described above, the component can have, for example, the shape of a simple or relieved leaf spring, or the shape of any desired torsion bar, or that of a cylindrical or conical helical spring. As connecting elements and/or closure elements, for example hollow bodies, the components, made of memory alloy, can exhibit the most diverse shapes, of which FIGS. 14 to 17 show only a selection. In particular, the component can have the shape of a simple or relieved cylindrical, square, hexagonal or octagonal hollow body. In addition, the component can be designed as a solid or perforated cylindrical or polygonal disk, relieved on one side or on two sides, and provided with a thickened edge.

The components, made from a mechanically unstable $\beta$-titanium alloy, can be used, for example, as temperature-dependent triggering elements in electrical switches, as temperature sensors in general, as permanent or detachable connecting sleeves for tubes and rods, and as permanent or detachable seals (disk-shaped or sleeve-shaped) for ceramic constructional elements.

By virtue of the fact that three different memory effects are achieved, the process, according to the invention, and the components, manufactured in accordance therewith, significantly widen the range of available materials, and the range of application of the memory alloys. This applies, in particular, to applications above room temperature (specifically at 100° C. and above) where there is a technological gap which must be closed. Moreover, $\beta$-titanium alloys are distinguished by good hot and cold ductilities, and by good machinability. Furthermore, in the case of Ti-10V-2Fe-3Al, a commercially obtainable alloy is available, offering significant economic advantages compared to previous, conventional memory alloys with a different alloy-basis.

We claim:

1. A process for manufacturing a component from a titanium alloy, which, in the stable starting condition, contains at least some of the body-centered phase at room temperature, in which process the components are mixed, melted and cast, and the workpiece obtained in this manner is hot-worked and subjected to a solution-annealing treatment in the temperature region in which at least some of the stable $\beta$-phase exists, and is subsequently quenched to room temperature, after which it is subjected to a mechanical working operation and a further heat treatment, wherein the alloy belongs, in its metallurgical composition, to the class of the mechanically unstable $\beta$-titanium alloys, which are defined by the fact that at least some of their cubic body-centered $\beta$-phase can, by applying a permanent deformation, be transformed into the stress-induced martensitic $\alpha''$-phase, and wherein the workpiece is quenched to a temperature at which the $\beta$-phase is mechanically unstable, at a rate which is sufficiently high to retain the mechanically unstable $\beta$-phase and to suppress the formation of any new phase, except for the athermal $\omega$-phase and except for a maximum of 10% by volume of martensite, which is thermally induced by quenching, from the temperature region above the $\beta$-transformation or above a temperature which is sufficiently high to cause at least some of a $\beta$-phase to form, which, in its turn, is unstable, and wherein the mechanical working operation comprises the application of tension, pressure, shear, or a combination of two or more of these operations, in the temperature range in which the $\beta$-phase is mechanically unstable and is carried out in a manner such that a permanent deformation of up to a maximum of 7% is produced, and wherein the further heat treatment at least comprises a heating operation.

2. The process as claimed in claim 1, wherein the further heat treatment comprises a heating operation to a temperature above $A_S$, $A_S$ being that temperature at which 1/100 of the permanent mechanical deformation, previously applied, is reformed.

3. The process as claimed in claim 1, wherein the further heat treatment comprises a heating operation to a temperature which is sufficiently high to cause the $\alpha$-phase to precipitate, and also comprises holding this temperature until at least 1% by volume of the original phases have transformed into the $\alpha$-phase.

4. The process as claimed in claim 1, wherein the further heat treatment comprises a heating operation to a temperature above $A_{90}$, and subsequent cooling to a temperature below $A_S$, $A_{90}$ being that temperature at which the microstructure contains a maximum of 10% by volume of martensite, and $A_S$ being that temperature at which 1/100 of the permanent mechanical deformation, previously applied, is reformed.

5. The process as claimed in claim 1, wherein the titanium alloy contains at least one of the elements V, Al, Fe, Ni, Co, Mn, Cr, Mo, Zr, Nb, Sn, and Cu.

6. The process as claimed in claim 5, wherein the concentration limits of the alloying elements of the titanium alloy, expressed in atomic percentages, satisfy the formula $$-1100 \leqq \sum_{i}^{n} (A_i X_i + B_i X_i^2) \leqq -700$$

in which $X_i$ stands for the concentration of the element in question, in atomic percent, and the coefficients $A_i$ and $B_i$ are assigned to the element in question in accordance with the Table below:

| Element | $A_i$ | $B_i$ |
|---|---|---|
| V | −29.1 | −1.8 |
| Al | −15.6 | +1.1 |
| Fe | −132.8 | −17.2 |
| Ni | −67.5 | −1.5 |
| Co | −72.0 | −6.0 |
| Mn | −84.9 | −7.6 |
| Cr | −72.0 | −6.0 |
| Mo | −66.7 | −3.3 |
| Zr | −16.9 | −0.3 |
| Nb | −19.3 | −0.53 |
| Sn | −25.2 | +1.8 |
| Cu | −38.3 | −1.3 |

7. The process as claimed in claim 6, wherein the titanium alloy is of the binary type and, in addition to titanium, further contains 14 to 20% by weight of vanadium, or 4 to 6% by weight of iron, or 6.5 to 9% by weight of manganese, or 13 to 19% by weight of molybdenum.

8. The process as claimed in claim 6, wherein the titanium alloy is of the ternary type and, in addition to titanium, further contains 13 to 19% by weight of vanadium plus 0.2 to 6% by weight of aluminum, or 4 to 6% by weight of iron plus 0.2 to 6% by weight of aluminum, or 1.5 to 2.3% by weight of iron plus 10 to 14% by weight of vanadium.

9. The process as claimed in claim 6, wherein the titanium alloy is of the quaternary type and, in addition to titanium, further contains 9 to 11% by weight of vanadium, plus 1.6 to 2.2% by weight of iron, plus 2 to 4% by weight of aluminum.

10. The process as claimed in claim 9, wherein the titanium alloy is composed of 10% by weight of vanadium, 2% by weight of iron and 3% by weight of aluminum, the remainder being titanium.

11. A component, made of titanium alloy, which, in the starting condition, is composed, at room temperature, of a $(\alpha+\beta)$-structure and which is available in a metastable structural condition resulting from solution-annealing above the $\beta$-transformation temperatures and subsequent quenching, wherein the alloy, in its metallurgical composition, belongs to the class of the mechanically unstable $\beta$-titanium alloys, this class being defined in the following manner:

an alloy which, following a solution-annealing treatment above the $\beta$-transformation temperature and subsequent quenching in ice-water with a cooling time not exceeding 10 seconds for passing through the drop in temperature between the $\beta$-transformation temperature and a temperature of 100° C., and after subsequent mechanical working, can be transformed, at least partially, into the stress-induced martensitic phase, and wherein, after quenching, the component is available in the condition of stress-induced martensite, in the form of the $\alpha''$-structure, and exhibits a memory effect, as a result of applying a permanent deformation of up to a maximum of 7%, by tension, compression, shear, or a combination of these states of deformation.

12. The component as claimed in claim 11, wherein, after heating to a temperature corresponding to the $A_F$ point, it is available in the form of $\beta$-structure and exhibits a one-way memory effect, $A_F$ denoting that temperature at which the retransformation of the martensite, into the high-temperature phase, has been completed to the extent of 99%.

13. The component as claimed in claim 11, wherein, after heating to a temperature between the $A_S$ point and the $A_F$ point, it is available partially in the form of $\alpha''$-structure, and partially in the form of the $\beta$-structure, and exhibits a continuous two-way memory effect, $A_S$ denoting that temperature at which 1/100 of the mechanical deformation, which was previously applied, is reformed, and $A_F$ denoting that temperature at which the retransformation of the martensite, into the high-temperature phase, has been completed to the extent of 99%.

14. The component as claimed in claim 11, wherein, after heating to a temperature lying not less than 50° C. above the $A_F$ point and after being held at this temperature for an appropriate time, it is available partially in the form of $\beta$-structure and partially in the form of $\alpha$-structure, and exhibits an irreversible, isothermal memory effect, $A_F$ denoting that temperature at which the retransformation of the martensite, into the high-temperature phase, has been completed to the extent of 99%.

15. The component as claimed in one of the claims 12 to 14, wherein said component possesses the shape of a simple leaf spring, or of a shouldered leaf spring, or the shape of a torsion bar, or the shape of a cylindrical or conical helical spring.

16. The component as claimed in one of the claims 12 to 14, wherein said component possesses the shape of a cylindrical, square, hexagonal, or octagonal hollow body, which may be simple or may have a shoulder.

17. The component as claimed in one of the claims 12 to 14, wherein said component possesses the shape of a solid or perforated cylindrical or polygonal disk, which is provided with a thickened edge, and may be relieved on one side, or on both sides.

18. A method of manufacturing a temperature dependent electrical switch, comprising:

fabricating the temperature dependent triggering element of said switch from the alloy component of claim 12 or 13.

19. A method of manufacturing tubes and rods, comprising:

fabricating the fixed or detachable connecting sleeve for said tubes and rods from the alloy component of claim 12 or 13.

20. A method of manufacturing tubes and rods, comprising:

fabricating the fixed or detachable sleeve for said tubes and rods from the alloy component of claim 12 or 14.

21. A method of manufacturing a ceramic component, comprising:

fabricating the fixed or detachable disk-shaped or sleeve-shaped sealing element of said ceramic component from the alloy component of claim 12 or 13.

* * * * *